United States Patent [19]

Takahashi et al.

[11] Patent Number: 4,803,149

[45] Date of Patent: Feb. 7, 1989

[54] SILVER HALIDE PHOTOGRAPHIC MATERIALS

[75] Inventors: Toshiro Takahashi; Ken-ichi Kuwabara; Masahiro Okada, all of Kanagawa, Japan

[73] Assignee: Fuji Photo Film Co., Ltd., Kanagawa, Japan

[21] Appl. No.: 915,593

[22] Filed: Oct. 6, 1986

[30] Foreign Application Priority Data

Oct. 4, 1985 [JP] Japan ..... 60-221498

[51] Int. Cl.[4] ..... G03C 1/36; G03C 5/26

[52] U.S. Cl. ..... 430/264; 430/265; 430/267; 430/949; 430/606; 430/512; 430/445; 430/446; 430/448

[58] Field of Search ..... 430/606, 949, 512, 264, 430/265, 267, 445, 446, 448

[56] References Cited

U.S. PATENT DOCUMENTS 3,533,794 10/1970 Ohi et al. ..... 430/512
4,169,733 10/1979 Iytaka et al. ..... 430/949
4,268,620 5/1981 Iytaka et al. ..... 430/949
4,452,882 6/1984 Akimura et al. ..... 430/949
4,681,836 7/1987 Inoue et al. ..... 430/949

*Primary Examiner*—Won H. Louie
*Attorney, Agent, or Firm*—Sughrue, Mion, Zinn, Macpeak and Seas

[57] ABSTRACT

A silver halide photographic material for a bright room and a process for producing the photographic material are disclosed, wherein the silver halide photographic material for a bright room comprises a support having thereon at least one silver halide emulsion layer containing silver chloride grains or silver chlorobromide grains containing at least 80 mol % silver chloride, at least one of said silver halide emulsion layer or another hydrophilic colloid layer(s) present containing a yellow dye making the silver halide photographic material substantially insensitive to visible light of 420 n.m. or more and an ultraviolet absorbent in an amount sufficient to reduce the specific sensitivity of the silver halide emulsion at 360 n.m. to ½ or lower than ½ thereof in the absence of the ultraviolet absorbent, and the $\gamma$ value of the silver halide photographic material being at least 10.

12 Claims, 1 Drawing Sheet

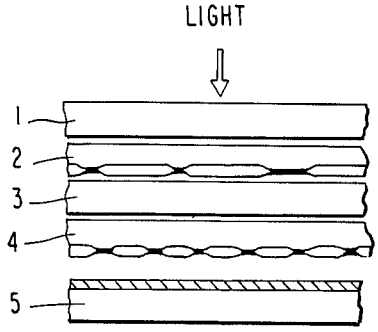
LIGHT
1
2
3
4
5

SILVER HALIDE PHOTOGRAPHIC MATERIALS

FIELD OF THE INVENTION

This invention relates to a silver halide photographic material and more particularly to a silver halide photographic material capable of being handled under substantially bright surroundings, e.g., in a normally lit room. (hereafter simply "a bright room").

BACKGROUND OF THE INVENTION

In a step of producing printing plates, recently, photographic light-sensitive materials which can be handled in bright room in spite of using silver halide as the photographic element are being developed which meet the requirement of performing a contact exposure (so-called contact work) using a relatively low-speed light-sensitive material. Such results are attained by exposing a light-sensitive material having greatly reduced light sensitivity (about $1/10^4$ to $1/10^5$ that of ordinary sensitivity) to visible light to a light source containing a high proportion of ultraviolet (e.g., a very high pressure mercury lamp, a metal halide lamp, etc.), under a safe light containing substantially no ultraviolet.

On the other hand, in contact work, simple one sheet contact work (i.e., a nega/posi image conversion is performed contact-exposing one image-exposed and developed photographic film as an original and a light-sensitive material for contact work) and high-level image-conversion work for making so-called white lettering, on a solid background or a white-on-black headline are performed. The term "white lettering on a solid background" means uninked portions of letters, marks, etc., in a dot-like inked pattern on paper (dotted portion) or a wholly inked portion on paper (called "a solid black portion") in printed material.

The manner of making white lettering on a black background in producing printing plates will now be explained more practically.

As shown in FIG. 1, a base 1 has adhered thereto a developed film 2 (line image) having line positive images such as letters, marks, etc., is disposed on a transparent or translucent base 3 (usually a polyethylene terephthalate film a few hundred μm in thickness) which has adhered thereto a developed film (dot image original) which has dot images. The dot image portion of the assembly is brought into intimate contact with an emulsion surface of a light-sensitive material 5 for contact work followed by light-exposure development to form white line image portions in the dot images.

An important point in the above procedure is that the dot image and line image must be subjected to a nega-posi image conversion according to the dot area and the line width, respectively. For example, a dot image having 50% black area must be correctly converted into a dot image having a 50% white area and a line image having a black line width of 50 μm must be correctly converted into a line image having a white line width of 50 μm. However, as is clear from FIG. 1, the dot image is exposed to the light-sensitive material for contact work in a state of intimate contact with the emulsion surface of the light-sensitive material, while the line image is exposed to the light-sensitive material through the dot image original 4 (usually having a thickness of about 110 μm) and the base 3 therefor (usually having a thickness of 100 μm). In other words, the line image is exposed to the light-sensitive material for contact work as a vague line image since exposure is carried out through transparent or translucent spacers a few hundred μm thick. Accordingly, when conventional exposure amount (the exposure amount to faithfully nega/-posi convert a dot image) is applied, the white line width of the line image becomes narrow by the influence of the diffused exposure. On the other hand, when the exposure amount is reduced to reducing the influence of the exposure to faithfully perform the nega-posi conversion of the line width of the line image, the dot area is reduced due to the insufficiency of the exposure.

Further, an attempt to reducing the influence of the exposure through multiple substrates to improve the quality of white lettering on solid background encounters the problem that adhering traces of a tape used to fix the line image or dot imates on the base and pin hole marks are liable to appear.

Also, a silver halide light-sensitive material for contact work in a bright room is liable to form pin holes due to dust, etc., when it is exposed to ultraviolet rays as compared with conventional light-sensitive materials for contact work in a dark room.

Means for preventing a reduction of the quality of white lettering on a black background and a reduction in image quality due to the formation of adhering tape traces and pin hole marks have scarcely been reported until now since the above-described procedures are different from conventional improvements in photographic characteristics (e.g., sensitization, improvement of dot image quality, increasing the contrast of a characteristic curve, etc.), directed to improving a light-sensitive materials for making printing plates.

SUMMARY OF THE INVENTION

The major object of this invention is, therefore, to provide a silver halide photographic material for a bright room, which can be handled under a bright safe light (in a bright room) including visible rays which provides excellent white letter-quality on a black background as compared to conventional light-sensitive materials for a bright room with loss adherence of tape trace and less pin hole marks. The term "bright room" means a surroundings wherein a room light containing visible rays under which a photosensitive material does not cause fog is used.

The above-described object of this invention is attained as set forth below.

That is, the invention relates to a silver halide photographic material for a bright room comprising a support having thereon at least one silver halide emulsion layer containing silver chloride grains or silver chlorobromide grains containing at least 80 mol% silver chloride, at least one of said silver halide emulsion layer on other hydrophilic colloid layer(s) containing a yellow dye which renders the silver halide photographic material substantially insensitive to visible light having a wavelength of 420 n.m. or more and a ultraviolet absorbent in an amount capable of reducing the specific sensitivity of the silver halide emulsion at 360 n.m. to ½ or less than ½ thereof, preferably from ½ to 1/100, more preferably from ½ to 1/20 to the specific sensitivity of an otherwise identical silver halide emulsion free of the ultraviolet absorbent, and the $\gamma$ value of the silver halide photographic material being at least 10, preferably from 10 to 50 more preferably from 10 to 30.

The term "substantially insensitive to visible light" means that a silver halide photographic material has 0.02 or less, preferably 0.01 or less, of fog when it is exposed to 200 lux of fading preventing fluorescent lamp made by Toshiba Corporation through a sharp cut filter SC-42 (a filter with 50% transmittance at 420 n.m., absorbing light of shorter wavelengths than 420 n.m. and transmitting light of longer wavelengths, made by Fuji Photo Film Co., Ltd.) for 60 minutes, and developed with a developer of Example 1 of the present specification.

The term "specific sensitivity of silver halide emulsion" is defined in *The Theory of the Photographic Process,* 4th edition page 39 (published by Macmillan Co., 1977).

BRIEF DESCRIPTION OF THE DRAWING

The FIGURE is an enlarged view illustrating a procedure of making white letterings on a black background in photographically making a printing plate.

DETAILED DESCRIPTION OF THE INVENTION

The silver halide in the silver halide photographic material of this invention is silver chloride or silver chlorobromide containing at least 80 mol% and preferably at least 90 mol% silver chloride.

The silver halide emulsion for use in this invention may be or may not be chemically sensitized. In the case of applying chemical sensitization, conventional chamical sensitization can be used such as sulfur sensitization, reduction sensitization and noble metal sensitization can be used individually or as a combination thereof. Of these chemical sensitization methods, sulfur sensitization is preferred.

For sulfur sensitizer, one can use a sulfur compound contained in gelatin and other various sulfur compounds such as thiosulfates, thioureas, rhodanins, etc. Specific examples of sulfur sensitizers are given in U.S. Pat. Nos. 1,574,944, 2,278,947, 2,410,689, 2,728,668, 3,501,313, 3,656,952, etc.

A typical noble metal sensitization is a gold sensitization using a gold complex salt. Other noble metal sensitization methods include using complex salts of, for example, platinum, palladium, rhodium, etc., and these can be, as a matter of course, employed. Examples of noble metal sensitization are given in U.S. Pat. No. 2,448,060, British Pat. No. 618,061, etc.

As reduction sensitizers, a stannous salt, an amine, formamidines sulfinic acid, a saline compound, etc., can be used. Examples thereof are given in U.S. Pat. Nos. 2,487,850, 2,518,698, 2,983,609, 2,983,610, 2,694,637, etc.

The mean grain size of the silver halide grains for use in this invention is preferably less than 0.5 μm more preferably 0.5 μm to 0.05 μm, most preferably 0.3 μm to 0.05 μm. The term "mean grain size" is conventionally used in the silver halide photographic arts and will be easily understood by one skilled in the art. When a silver halide grain is a sphere or a grain similar to a sphere, grain size means the diameter of the grain. When a silver halide grain is cubic, the grain size is $$\left(\text{the long side length} \times \sqrt{\frac{4}{\pi}}\right)$$

and is the algebraic average or geometarical average based on the mean grain projected area. Details of the method of obtaining the mean grain size are given, for example, in C. E. Mees and T. H. James, *The Theory of the Photographic Process,* 3rd edition, pages 36–43 (published by Macmillan Co., 1966).

There is no particular restriction on the form of the silver halide grains for use in this invention. That is, the form of the silver halide grains may be tabular, spherical, regular-cubic, regular-octahedral, etc. It is preferred, however, that the grain size distribution be narrow and in particular, a mono-dispersed silver halide emulsion wherein 90%, preferably 95%, of all grains are in a grain size range of ±40% of the mean grain size is preferred.

As methods for reacting a soluble silver salt and a soluble halide to prepare silver halide grains for use in this invention conventional methods such as a single jet method, a double jet method, or a combination thereof can be used.

A conventional back mixing method (or back jet method) for forming silver halide grains in the presence of excessive silver ions can also be used.

As one conventional double jet method, a controlled double jet method involving maintaining a constant pAg in the liquid phase for forming silver halide grains can be used. According to this method, a silver halide emulsion containing silver halide grains having a regular crystal form and an almost unirom grain size can be obtained.

The formation of the silver halide grains is preferably performed under acidic conditions. According to our experiments, we found that the effect of the present invention is reduced when the silver halide grains are formed under neutral or alkaline conditions. The pH range for forming the silver halide grains preferably is at most 6, more preferably 6 to 1, most preferably 5 to 1.

Two or more silver halide emulsion layers may be formed which include the dye and absorbent per the present invention, but usually one emulsion layer is enough. The coating amount of silver (silver coverage) of the silver halide emulsion is preferably in the range of 1 $g/m^2$ to 8 $g/m^2$.

Per the present invention, to improve the ease handling a silver halide photographic material in a bright room, a yellow dye which renders the silver halide photographic material substantially insensitive to visible light of 420 n.m. or more in wavelength. As the yellow dye, a dye having a peak in the range of 420 to 550 n.m., preferably in the range of 420 to 500 n.m. can be used.

There is no particular restriction on the chemical structure of the yellow dye used and oxonol dyes, hemioxonol dyes, merocyanine dyes, cyanine dyes, azo dyes, etc., can be used and of these dyes, water-soluble dyes are advantageous in the sense of preventing the formation of any color residue after processing.

Specific examples of useful yellow dyes are the pyrozolooxonol dyes described in U.S. Pat. No. 2,274,782, diarylazo dyes described in U.S. Pat. No. 2,956,879, the styryl dyes and butadienyl dyes described in U.S. Pat. Nos. 3,423,207 and 3,384,487, the merocyanine dyes described in U.S. Pat. No. 2,527,583, the merocyanine dyes and oxonol dyes described in U.S. Pat. Nos. 3,486,897, 3,652,284, and 3,718,472, the enaminohemioxonol dyes described in U.S. Pat. No. 3,976,661, the arylidene dyes described in Japanese patent Application (OPI) Nos. 3623/76, 20,822/77 (the term "OPI" as used herein means an "unexamined published Japanese patent application"), Japanese Patent Application Nos. 54,883/85, 21,306/85, 117,456/85, and 54,883/85, and the dyes described in British Patent Nos.

584,609 and 1,177,429 and in Japanese Patent Application (OPI) Nos. 85130/73, 99620/84, 114,420/84 and U.S. Pat. Nos. 2,533,472, 3,148,187, 3,177,078, 3,247,127, 3,540,887, 3,575,704, and 3,653,905.
Specific examples of dyes for use in this invention are shown below but the dye for use in this invention are not limited to these dyes.
I-1
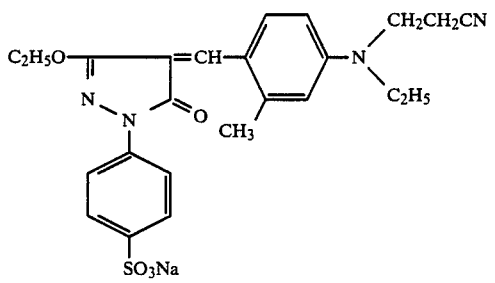
I-2
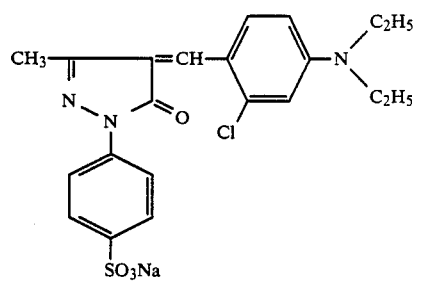
I-3
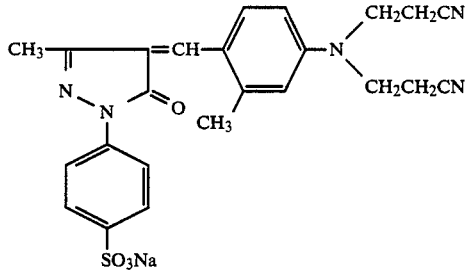
I-4
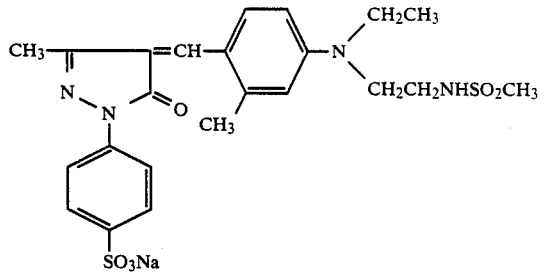
I-5
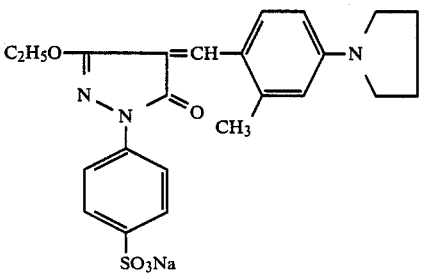
I-6
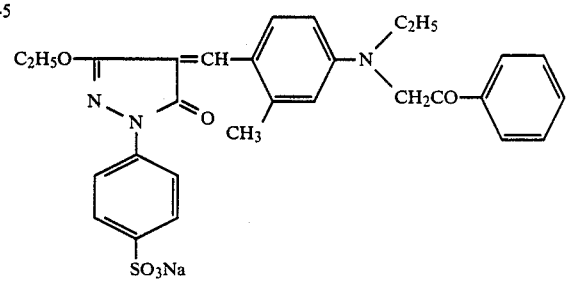
I-7
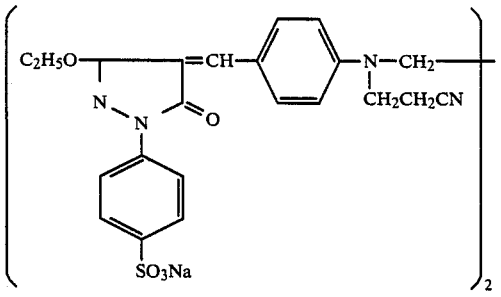
I-8
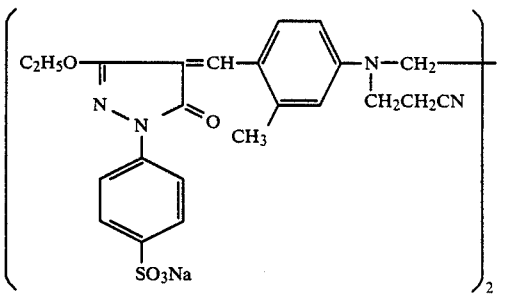
I-9
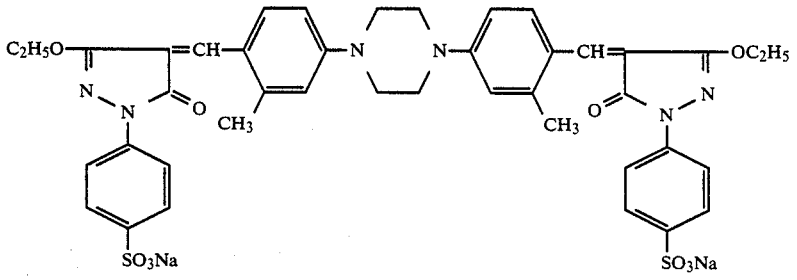

-continued

I-10

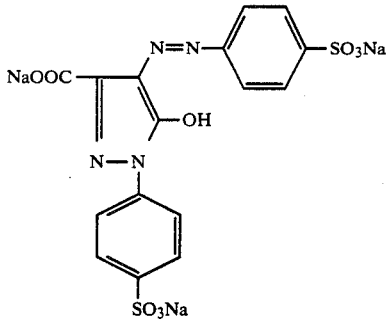

I-11

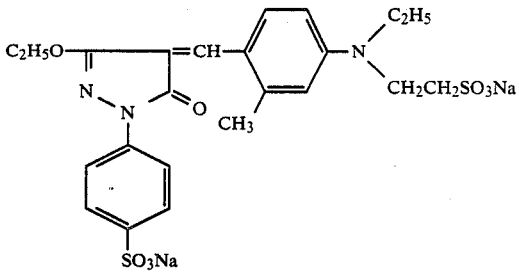

I-12

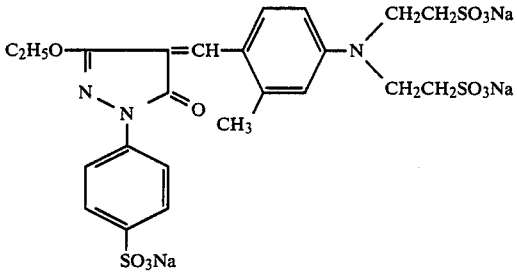

I-13

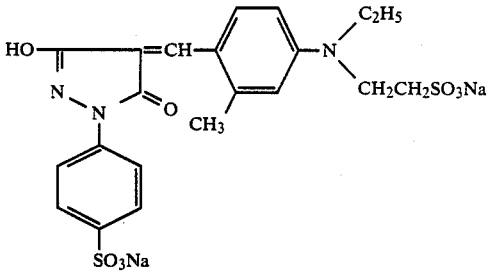

I-14

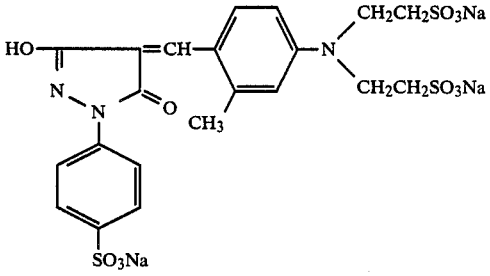

I-15

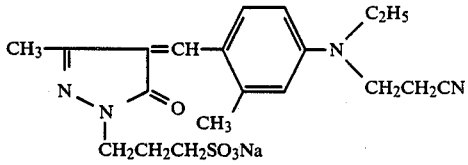

Per the present invention, a yellow dye is added so that the silver halide photographic material will not exhibit substantial sensitivity to visible light of a wavelength of 420 n.m. or longer than 420 n.m. The amount of the yellow dye added is such that the absorbance at a 420 n.m. wavelength is at least 0.2, more preferably at least 0.4, most preferably 0.4 to 3.0. The amount thereof depends upon the molar extinction co-efficient of the dye i.e., as a dye has a large value of molar extinction co-efficient, the required amount of the dye to provide the same value of molar extinction coefficient is small. The amount thereof usually in the range of $10^{-3}$ g/m$^2$ to 1 g/m$^2$.

The yellow dye per the present invention can be present in the silver halide emulsion layer, a protective layer for the emulsion layer, an interlayer, etc., of the silver halide photographic material of this invention.

Per the present invention, an ultraviolet absorbent is used in an amount sufficient to reduce the specific sensitivity of the silver halide emulsion below ½ thereof to improve the quality of white lettering on a black background and to reduce the formation of adhering tape traces and pin hole marks. As the ultraviolet absorbent, an ultraviolet absorbent having a peak absorbance in the range of 300 to 400 n.m., more preferably 300 to 380 n.m., can be used. The "peak absorbence" is defined by a wavelength corresponding to a maximum absorbence of a dye containing- or absorbent containing-glatin layer, on a transparent base which is obtained using spectrophotometer.

Examples of ultraviolet absorbents for use in the present invention include aryl group-substituted benzotriazole compounds, 4-triazolidone compounds, benzophenone compounds, cinnamic acid ester compounds, butadiene compounds, benzoxazole compounds and ultraviolet absorptive polymers.

Specific examples of ultraviolet absorbents for use in the present invention are described in U.S. Pat. Nos. 3,533,794, 3,314,794, 3,352,681, Japanese Patent Application (OPI) No. 2784/71, U.S. Pat. Nos. 3,705,805, 3,707,375, 4,045,229, 3,700,455, 3,499,762, West German Patent Publication No. 1,547,863, etc.

The ultraviolet absorbent used in the present invention has a peak absorbence in the range of 300 to 400 n.m., and the yellow dye used in the present invention has a peak absorbence in the range of 420 n.m. or more. Therefore, the ultraviolet absorbent reduces the specific sensitivity of the silver halide emulsion below ½ thereof to improve a stability to ultraviolet light, and the yellow dye improves a stability to light having wavelength of 420 n.m. or more.

Accordingly, it is preferable that the photosensitive material is treated under a light containing visible light of 420 n.m. or more and exposure is carried out within a wavelength range of 360 to 420 n.m.

Ultraviolet absorbents for use in this invention are illustrated below but the invention is not limited to these materials.

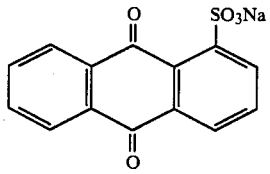
II-1
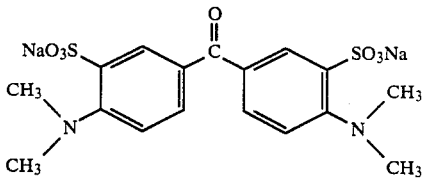
II-2
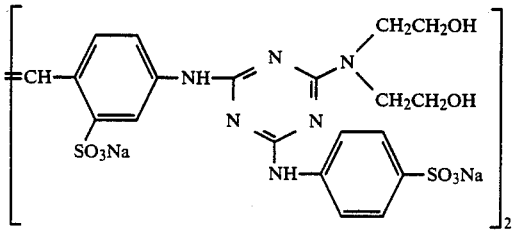
II-3
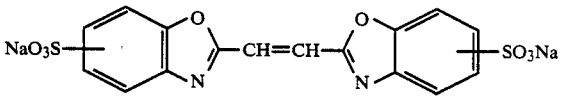
II-4
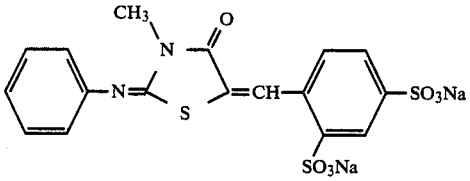
II-5
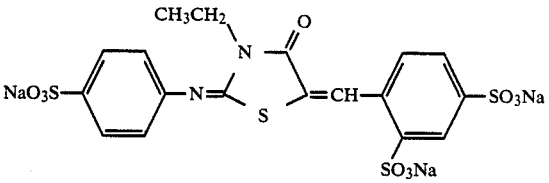
II-6
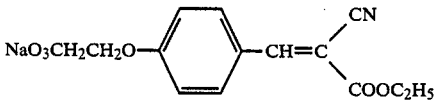
II-7
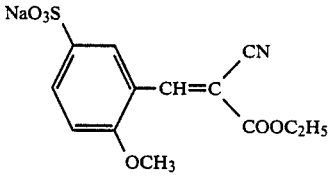
II-8
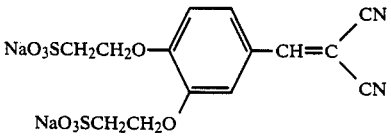
II-9
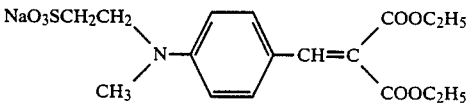
II-10
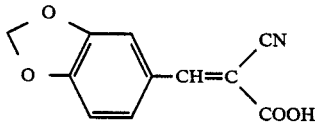
II-11
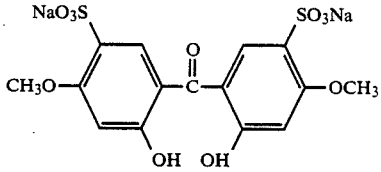
II-12
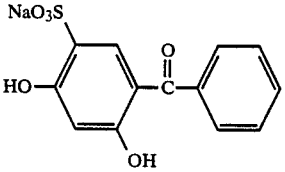
II-13
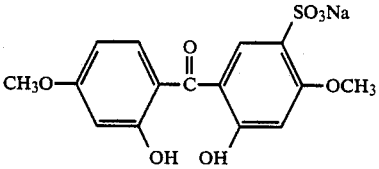
II-14
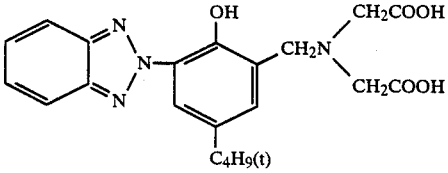
II-15
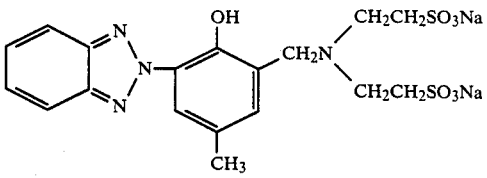
II-16

-continued
II-17
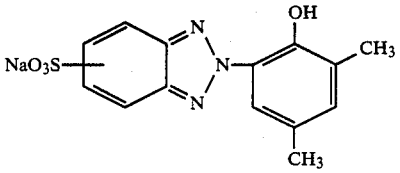
II-18
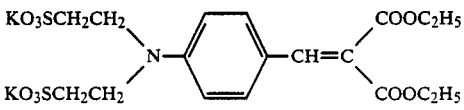
II-19
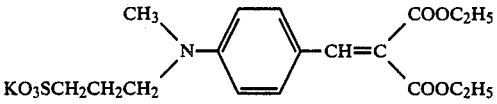
II-20
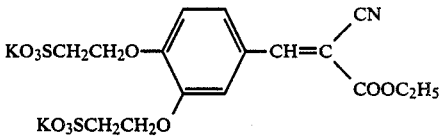
II-21
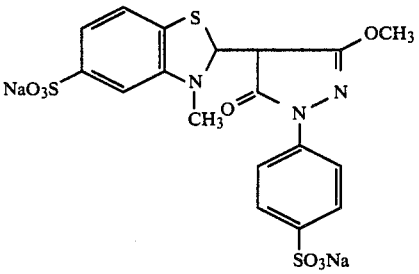
II-22
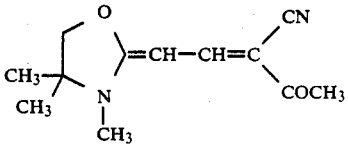
II-23
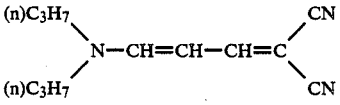
II-24
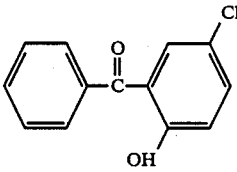
II-25
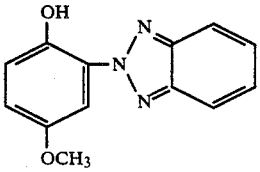
II-26
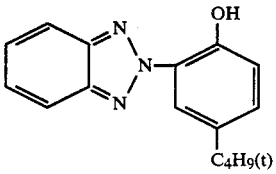
II-27
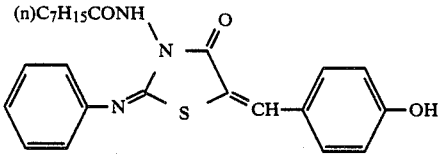
II-28
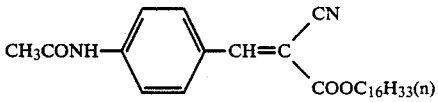
II-29
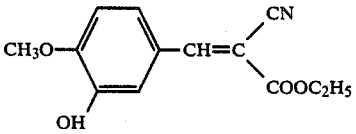
II-30
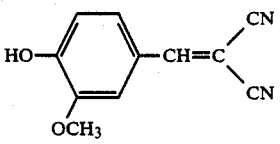
II-31
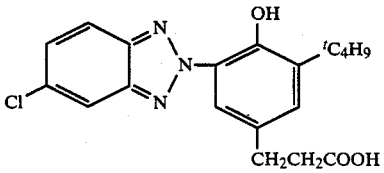
II-32
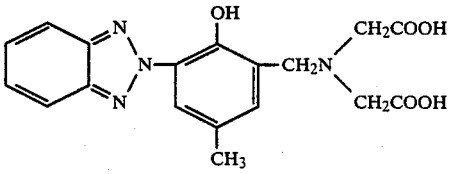
II-33
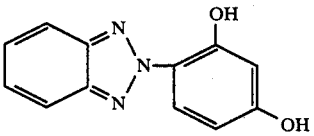
II-34
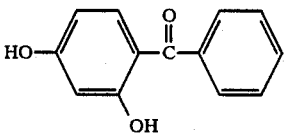

-continued
II-35
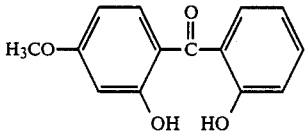
II-36
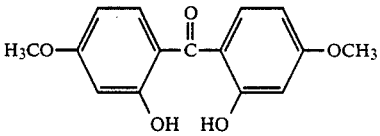
II-37
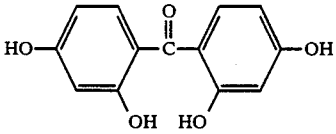
II-38
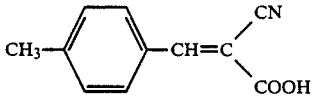
II-39
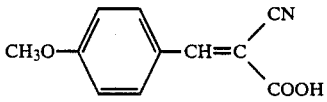
II-40
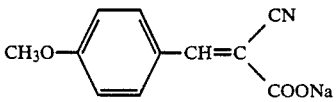
II-41
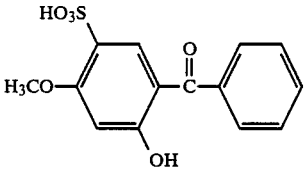
II-42
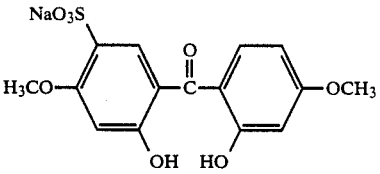
II-43
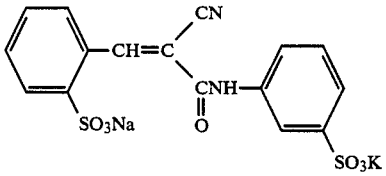
II-44
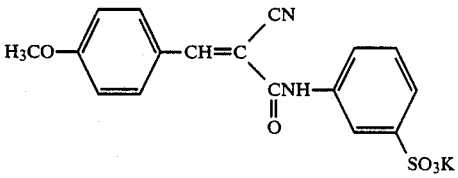
II-45
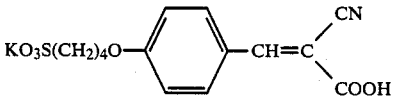
II-46
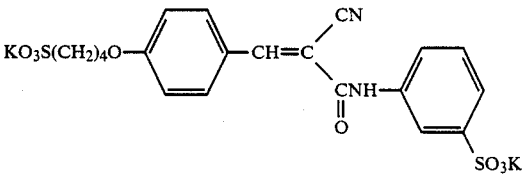
II-47
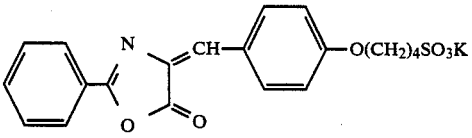
II-48
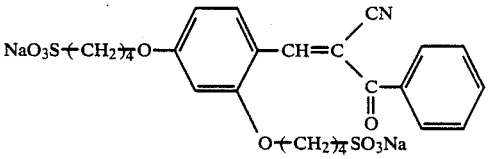
II-49
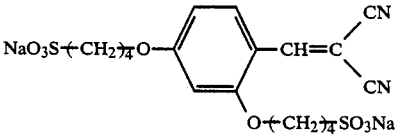
II-50
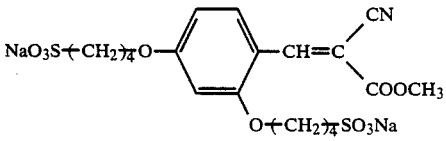
II-51
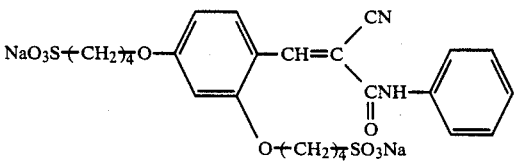
II-52
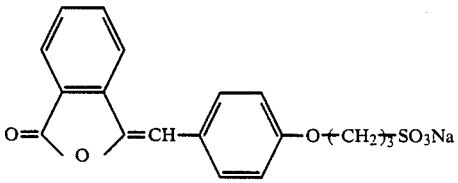

-continued

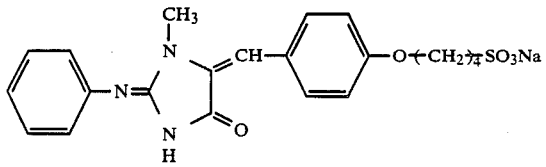

II-53

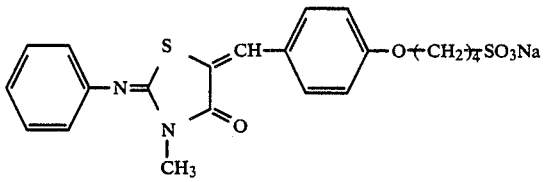

II-54

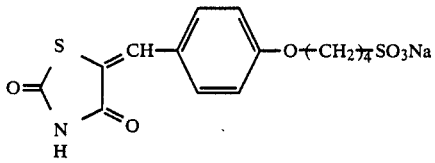

II-55

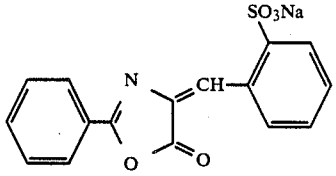

II-56

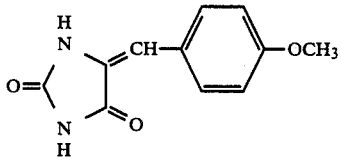

II-57

In the present invention, the ultraviolet absorbent is added in an amount such that the specific sensitivity of the silver halide emulsion at 360 n.m. is reduced to below ½ the specific sensitivity of the ultraviolet absorbent is absent and the amount added is such that the absorbance at 360 n.m. becomes at least 0.3, preferably at least 0.4.

The addition amount also depends upon the molar extinction coefficient of the ultraviolet absorbent but is usually in the range of $10^{-3}$ g/m$^2$ to 1 g/m$^2$.

The ultraviolet absorbent can be incorporated in the silver halide emulsion layer, a surface protective layer, an interlayer, etc.

The ultraviolet absorbent can be added to a coating composition of a light-insensitive hydrophilic colloid layer of the silver halide photographic material as a solution in an appropriate solvent such as water, an alcohol (e.g., methanol, ethanol, propanol, etc.), acetone, methyl cellosolve, etc., or a mixture thereof.

The ultraviolet absorbents and yellow dyes may be used singly or as a mixture thereof, respectively.

Per the present invention, the ultraviolet absorbent may be present in a layer with the above-described yellow dye or may be present in a layer different from the layer containing the yellow dye.

To increase the $\gamma$ value of the silver halide photographic material of this invention is above 10, a member of different procedures can be used. For example, one can process the silver halide photographic material containing a specific hydrazine derivative as disclosed in U.S. Pat. Nos. 4,166,742, 4,168,977, 4,221,857, 4,224,401, 4,243,739, 4,272,606, 4,311,781, etc., with a developer containing a sulfite preservative in an amount of at least 0.15 mol/liter and at pH of 10.5 to 12.3 having good storage stability, process the silver halide photographic material containing a tetrazolium compound is disclosed in Japanese Patent Application (OPI) Nos. 18,317/77, 17,719/78 and 17,720/78 with a developer comprising p-aminophenol type developing agent and dihydroxybenzene developing agent (PQ type developer) or a developer comprising 1-phenyl-3-pyrazolidones developing agent and dihydroxybenzene developing agent (PQ type developer), or process the silver halide photographic material containing polyalkyleneoxide as disclosed in Japanese Patent Application (OPI) No. 190943/83 with a developer containing dihydroxybenzenes as a developing agent.

The $\gamma$ value per the present invention is the value given by the following equation when the exposure amount necessary for forming a blackened transmission density of 0.3 processed by each developer is defined as "A" and the exposure amount necessary for giving a blackened transmission density of 3.0 is defined as "B";

$$\gamma = -(3.0-0.3)/(\log A - \log B)$$

Examples of compounds preferably used in the case of increasing the $\gamma$ value of the silver halide photographic material using a hydrazine derivative are compounds represented by formula (III-1)

$$R_1-NHNH-G-R_2 \qquad \text{(III-1)}$$

wherein $R_1$ represents an aliphatic or aromatic group; or unsaturated heterocyclic group; $R_2$ represents a hydrogen atom, a substituted or unsubstituted alkyl group, a substituted or unsubstituted aryl group; a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, and include arylhydrazides represented by formula (III-2), as described in U.S. Pat. No. 4,478,928,

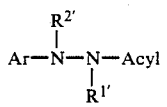

(III-2)

wherein Acyl is an acyl group, Ar is an aryl group, and $R^{1'}$ is a hydrogen atom or a sulfinic acid radical substituent and $R^{2'}$ is a sulfinic acid radical substituent when $R^{1'}$ is hydrogen atom and hydrogen atom when $R^{1'}$ is a sulfinic acid radical.

In formula (I), suitable aliphatic groups represented by $R_1$ include those containing from 1 to 30 carbon atoms, particularly preferably straight-chain, branched chain, and cyclic alkyl groups containing from 1 to 20 carbon atoms. Herein, the branched-chain alkyl groups may include those cyclized so as to form a saturated hetero ring containing one or more hetero atoms therein such as a nitrogen atom, an oxygen atom, a sulfur atom, a selenium atom, etc. Further, these alkyl groups may substituted with an aryl group containing from 6 to 12 carbon atoms, an alkoxy group containing from 1 to 10 carbon atoms, a sulfoxy group containing from 1 to 10 carbon atoms, a sulfonamido group containing from 1 to 10 carbon atoms, a carbonamido group containing from 1 to 10 carbon atoms, and so on.

In formula (III-1), aromatic groups represented by $R_1$ include monocyclic and dicyclic (conjugated) aryl groups.

The unsaturated heterocyclic groups represented by $R_1$ contain a nitrogen atom, an oxygen atom, a sulfur atom, a selenium atom, etc. as a heteroatom and may be groups formed by fusing together with a monocyclic or dicyclic aryl group.

Preferable examples of these aromatic groups represented by $R_1$ include phenyl, naphthyl, pyridyl, pyrimidinyl, imidazolyl, pyrazolyl, quinolyl, isoquinolyl, benzimidazolyl, thiazolyl, benzothiazolyl, and like groups. Of these groups, those containing a benzene nucleus are more desirable.

A particularly preferred group as $R_1$ is a phenyl group and a naphthyl group.

An aryl group or a unsaturated heterocyclic group represented by $R_1$ may have one or more substituent groups. Typical examples of such a substituent group include straight-chain, branched-chain and cyclic alkyl groups (preferably containing from 1 to 20 carbon atoms), aralkyl groups (an alkyl moiety of which preferably contains from 1 to 3 carbon atoms, and an aryl moiety of which contains one or two rings), an alkoxy groups (preferably containing from 1 to 20 carbon atoms), substituted amino groups (preferably having an alkyl substituent containing from 1 to 20 carbon atoms), acylamino groups (preferably containing from 2 to 30 carbon atoms), sulfonamido groups (preferably containing from 1 to 30 carbon atoms), ureido groups (preferably containing from 1 to 30 carbon atoms), thioureido groups thioamido groups, arylideneimino groups, heteroarylidene groups, alkylideneimino groups, etc.

In formula (III-1), alkyl groups represented by $R_2$ preferably contain from 1 to 4 carbon atoms, and they may be substituted with a halogen atom, a cyano group, a carboxy group, a sulfo group, an alkoxy group containing from 1 to 10 carbon atoms, a phenyl group, etc.

Aryl groups represented by $R_2$ contain one or two (condensed) rings, e.g., those containing a benzene ring. These aryl groups may be substituted with a halogen atom, an alkyl group containing from 1 to 10 carbon atoms, a cyano group, a carboxyl group, a sulfo group, etc.

Alkoxy groups represented by $R_2$ contain from 1 to 8 carbon atoms, and may be substituted with a halogen atom, an aryl group, etc.

Aryloxy groups represented by $R_2$ are preferably monocyclic. Substituent groups suitable therefor are halogen atoms, etc.

Of groups represented by $R_2$, those preferred over others are hydrogen atom, an alkyl group such as a methyl group, etc., an alkoxy group such as a methoxy group, an ethoxy group, etc., and a substituted or unsubstituted aryl group such as a substituted or unsubstituted phenyl group, etc., in the case where G represents a carbonyl group. In particular, a hydrogen atom is preferred as $R_2$.

In the case G represents a sulfonyl group, $R_2$ is preferably an alkyl group such as a methyl group, an ethyl group, etc.; a phenyl group; or a substituted aryl group such as 4-methylphenyl group, etc., and particularly preferably is a methyl group.

In the case G represents a phosphoryl group, $R_2$ is preferably an alkoxy group such as a methoxy group, an ethoxy group, a butoxy group, etc.; an unsubstituted aryloxy group such as a phenoxy group, etc., or an aryl group such as a phenyl group, etc., and particularly preferably is a phenoxy group.

In the case G represents a sulfoxy group, preferred $R_2$ is a substituted alkyl group such as a cyanobenzyl group, a methylthiobenzyl group or the like, while when G represents an N-substituted or unsubstituted iminomethylene group, preferred $R_2$ groups are a methyl group, an ethyl group, or a substituted or unsubstituted phenyl group.

Into $R_1$ or $R_2$ of formula (III-1) there may be introduced a ballast group as is commonly used in immobile photographic additives such as a coupler. A ballast group as used herein signifies a group containing not less than 8 carbon atoms preferably 8 to 20 carbon atoms which is relatively inert with respect to its influence on photographic properties, and can be selected from among alkyl groups, containing from 8 to 30 carbon atoms, alkoxy groups containing from 8 to 30 carbon atoms, phenyl group, alkylphenyl groups containing from 8 to 30 carbon atoms, phenoxy group, alkylphenoxy groups containing from 8 to 30 carbon atoms and the like.

Further, a group capable of increasing the adsorption to the surface of a silver of a silver halide grain may be introduced into $R_1$ or $R_2$ of formula (III-1). As examples of such adsorptive groups, mention may be made of those described in U.S. Pat. No. 4,385,108, such as thiourea groups, heterocyclic thioamido groups, mercaptoheterocyclic groups, triazol groups, etc.

The most preferred group as G of formula (III-1) is carbonyl group.

Specific examples of compounds represented by formula (III-1) are illustrated below. However, the present invention should not be construed as being limited to these examples.

III-1
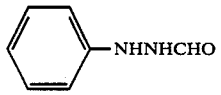
III-2
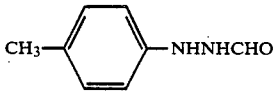
III-3
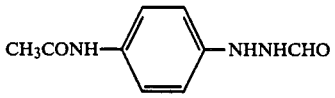
III-4
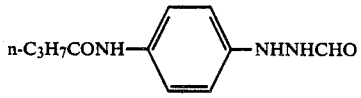
III-5
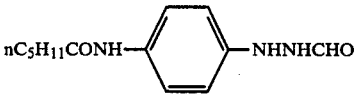
III-6
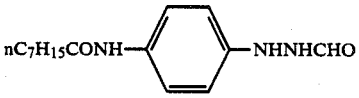
III-7
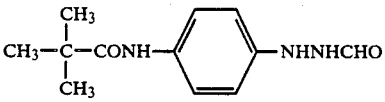
III-8
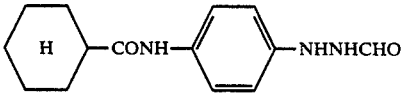
III-9
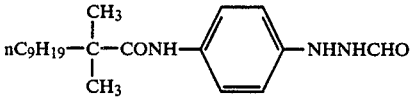
III-10
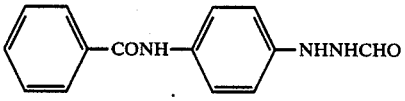
III-11
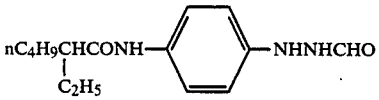
III-12
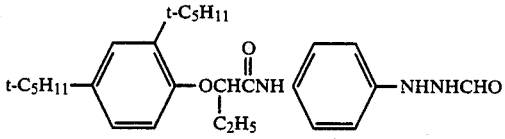
III-13
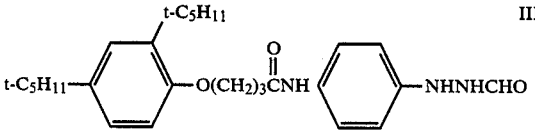
III-14
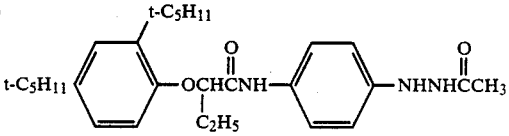
III-15
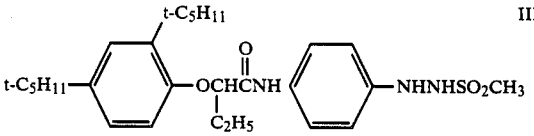
III-16
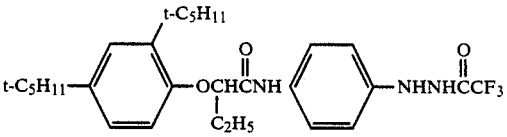
III-17
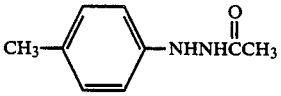
III-18
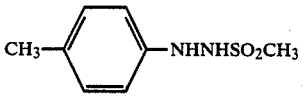
III-19
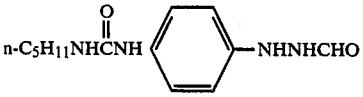
III-20
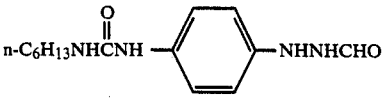
III-21
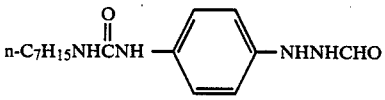
III-22
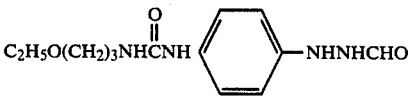
III-23
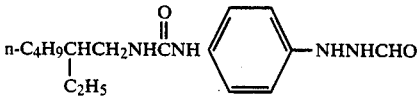
III-24
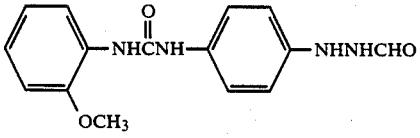

-continued

III-25

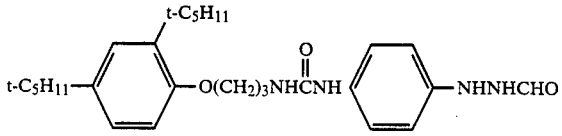

III-26

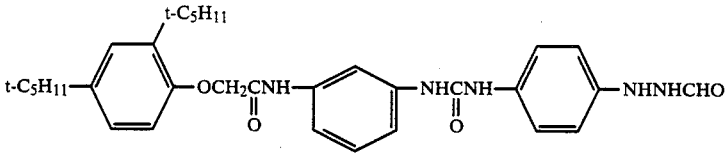

III-27

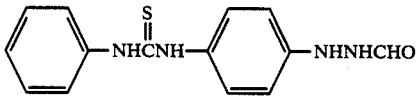

III-28

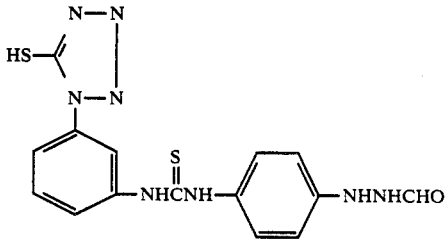

III-29

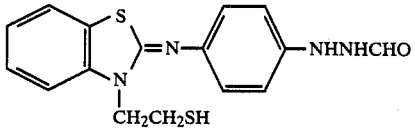

III-30

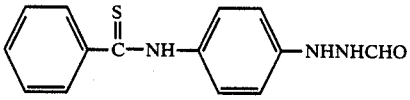

III-31

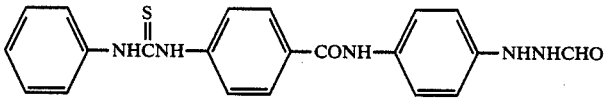

III-32

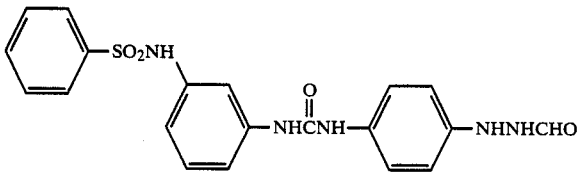

The hydrazine derivatives or arylhydrazides are well known compounds and prepared according to the processes as described in Japanese patent application (OPI) Nos. 89738/81, 153336/81, 99635/82, 58137/82, 129436/82, 129433/82, 129434/82, 129435/82, 83028/85, 93433/85, 112034/85, 129746/85, 140338/85, 140339/85, 140340/85, 179734/85, 200250/85, etc.

It is most effective to add a hydrazine derivative as above described per the present invention in an amount ranging from $1\times10^{-6}$ to $5\times10^{-2}$ mole. Particularly from $1\times10^{-5}$ to $2\times10^{-2}$ mole, per mole of silver halide.

In incorporating a hydrazine derivative which can be employed in the present invention into a photographic light-sensitive material, the hydrazine derivative can be added to a silver halide emulsion or a hydrophilic colloidal solution as an aqueous solution when it is soluble in water or as a solution prepared by dissolving it in a water miscible organic solvent, such as an alcohol (e.g., methanol, ethanol, etc.), esters (e.g., ethyl acetate), ketones (e.g., acetone) or the like, when it is insoluble in water.

The hydrazine derivatives may be added alone or as a mixture of two or more thereof.

A layer in which the hydrazine derivatives are to be incorporated may be either silver halide emulsion layer or another hydrophilic colloid layer. Also, the hydrazine derivatives may be incorporated in both silver halide emulsion layer and another hydrophilic colloid layer.

In the case of increasing the $\gamma$ value of the silver halide photographic material above 10 by using a tetrazolium compound, the compounds described in Japanese patent application (OPI) No. 18,317/77, 17,719/78, 17,720/78, etc., can be used. Typical tetrazolium compounds which can be used for the purpose are represented by following general formulae (IV) to (vI):

(IV)

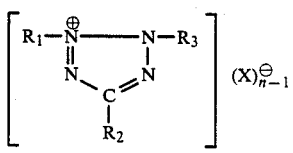

(V)

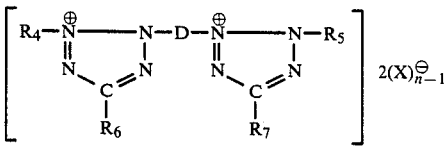

-continued

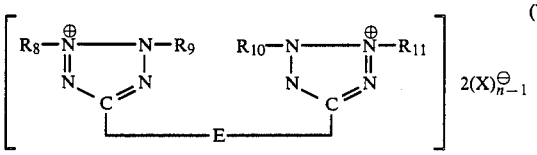

(VI)

In the above formulae, $R_1$, $R_3$, $R_4$, $R_5$, $R_8$, $R_9$, $R_{10}$, and $R_{11}$ each represents an allyl group, a phenyl group (e.g., a phenyl group, a tolyl group, a hydroxyphenyl a carboxyphenyl group, an aminophenyl group, a mercaptophenyl group, etc.), a naphthyl group (e.g., an α-naphthyl group, β-naphthyl group, a hydroxynaphthyl group, a carboxynaphthyl group, an aminonaphthyl group, etc.), or a heterocyclic group (e.g., a thiazolyl group, a benzothiazolyl group, an oxazolyl group, a pyrimidinyl group, a pyrimidinyl group, a pyridyl group, etc.), and these groups each may be a group forming a metal chelate or a complex; $R_2$, $R_6$ and $R_7$ each represents an allyl group, a phenyl group, a naphthyl group, a heterocyclic group, an alkyl group (e.g., a methyl group, an ethyl group, a propyl group, a butyl group, a mercaptomethyl group, a mercaptoethyl group, etc.), a hydroxy group, a carboxy group or a salt thereof, a carboxyalkyl group (e.g., a methoxycarbonyl group, an ethoxycarbonyl group, etc.), an amino group, (e.g., an amino group, an ethylamino group, an anilino group, etc.), a mercapto group, a nitro group, or a hydrogen atom; D represents a divalent aromatic group; E represents an alkylene group, an arylene group, or an aralkylene group; X represents an anion (e.g., a chloride ion, a bromide ion, perchlorate ion, etc.), and n represents 1 or 2; n is 1 when the compound of each general formula forms an intramolecular salt.

Specific examples of the tetrazolium compound for use in this invention are illustrated below but such is not intended to limit the compounds which can be used in this invention.

(1) 2-(Benzothiazol-2-yl)-3-phenyl-5-dodecyl-2H-tetrazolium-bromide.

(2) 2,3-Diphenyl-5-(4-t-octyloxyphenyl)-2H-tetrazoliumchloride.

(3) 2,3,5-Triphenyl-2H-tetrazolium.

(4) 2,3,5-Tri(p-carboxyethylphenyl)-2H-tetrazolium.

(5) 2-(Benzothiazol-2-yl)-3-phenyl-5-(o-chlorophenyl)-2H-tetrazolium.

(6) 2,3-Diphenyl-2H-tetrazolium.

(7) 2,3-Diphenyl-5-methyl-2H-tetrazolium.

(8) 3-(p-Hydroxyphenyl)-5-methyl-2-phenyl-2H-tetrazolium.

(9) 2,3-Diphenyl-5-ethyl-2H-tetrazolium.

(10) 2,3-Diphenyl-5-n-hexyl-2H-tetrazolium.

(11) 5-Cyano-2,3-diphenyl-2H-tetrazolium.

(12) 2-(Benzothiazol-2-yl)-5-phenyl-3-(4-tolyl)-2H-tetrazolium.

(13) 2-(Benzothiazol-2-yl)-5-(4-chlorophenyl)-3-(4-nitrophenyl)-2H-tetrazolium.

(14) 5-Ethoxycarbonyl-2,3-di(3-nitrophenyl)-2H-tetrazolium.

(15) 5-Acetyl-2,3-di(p-ethoxyphenyl)-2H-tetrazolium.

(16) 2,5-diphenyl-3-(p-tolyl)-2H-tetrazolium.

(17) 2,5-Diphenyl-3-(p-iodophenyl)-2H-tetrazolium.

(18) 2,3-Diphenyl-5-(p-diphenyl)-2H-tetrazolium.

(19) 5-(p-Bromophenyl)-2-phenyl-3-(2,4,6-trichlorophenyl)-2N-tetrazolium.

(20) 3-(p-Hydroxyphenyl)-5-(p-nitrophenyl-2-phenyl-2H-tetrazolium.

(21) 5-(3,4-Dimethoxyphenyl)-3-(2-ethoxyphenyl-2-(4-methoxyphenyl)-2H-tetrazolium.

(22) 5-(4-Cyanophenyl)-2,3-diphenyl-2H-tetrazolium.

(23) 3-(p-Actamidophenyl)-2,5-diphenyl-2H-tetrazolium.

(24) 5-Acetyl-2,3-diphenyl-2H-tetrazolium.

(25) 5-(Fluoro-2-yl)-2,3-diphenyl-2H-tetrazolium.

(26) 5-(Thien-2-yl)-2,3-diphenyl-2H-tetrazolium.

(27) 2,3-Diphenyl-5-(pyrido-4-yl)-2H-tetrazolium.

(28) 2,3-Diphenyl-5-(quinol-2-yl)-2H-tetrazolium.

(29) 2,3-Diphenyl-5-(benzoxazol-2-yl)-2H-tetrazolium.

(30) 2,3-Diphenyl-5-nitro-2H-tetrazolium.

(31) 2,2',3,3'-Tetraphenyl-5,5'-1,4-butylenedi-(2H-tetrazolium).

(32) 2,2',3,3'-Tetraphenyl-5,5'-p-phenylene-di-(2H-tetrazolium).

(33) 2-(4,5-Dimethylthiazol-2-yl)-3,5-diphenyl-2H-tetrazolium.

(34) 3,5-Diphenyl-2-(triazin-2-yl)-2H-tetrazolium.

(35) 2-(Benzothiazol-2-yl)-3-(4-methoxyphenyl)-5-phenyl-2H-tetrazolium.

The above tetrazolium compounds are obtained by conventionally known methods.

When the tetrazolium compounds is used in a non-diffusible form, the non-diffusible compound obtained by reacting a diffusible compound in the above-illustrated compounds and an anion is used.

As the anion moiety for use in such a case, there are higher molecular weight alkylbenzenesulfonic acid anions such as a p-dodecylbenzenesulfonic acid anion, etc., higher molecular weight alkylsulfuric acid ester anions such as a lauryl sulfate anion, etc., dialkyl sulfosuccinate anions such as a di-2-ethylhexyl sulfosuccinate anion, etc., polyether alcohol sulfuric acid ester anions such as a cetyl polyethenoxysulfate anion, higher fatty acid anions such as a stearic acid anion, etc. and a polymer such as a polyacrylic acid anion, etc., having an acid residue.

Also, the non-diffusible tetrazolium compound for use in this invention can be synthesized by appropriately selecting an anion moiety and a cation moiety. The non-diffusible tetrazolium compound can be prepared by separately dispersing the anion moiety and a cation moiety, which are both soluble salts, each in a gelatin solution followed by mixing them and dispersing the mixture in gelatin matrix or by previously synthesizing crystals of the oxidizing agent, dissolving the crystals in a solvent (e.g., dimethyl sulfoxide, etc.), and then dispersing the solution in gelatin matrix. For uniform dispersion, the above-described mixture may be dispersed by emulsification using ultrasonic waves or a high-pressure homogenizer.

In the case of the present invention, either a diffusible tetrazolium compound or a non-diffusible tetrazolium compound can be used, but images of higher contrast can be obtained using a non-diffusible tetrazolium compound. Accordingly, when requiring particularly excellent dot performance, the use of a non-diffusible tetrazolium compound is advantageous.

The tetrazolium compounds for use in this invention may be used solely or as a mixture thereof.

Also, in this invention, the tetrazolium compound(s) may be added to a silver halide emulsion layer or other hydrophilic colloid layer(s), or further may be added to both types of layers.

It is preferred that the tetrazolium compound(s) for use in this invention be used in the range of $1\times10^{-3}$ to $5\times10^{-2}$ mol per mol of silver halide.

To reduce the sensitivity of the silver halide emulsion and improve ease of handling the silver halide photographic material in a bright room, a water-soluble rhodium salt can be used in this invention. Specific examples of such a water-soluble rhodium salt are rhodium chloride, rhodium trichloride, rhodium ammonium chloride, etc. Further, complex salts of the aforesaid salts, such as $Na_3[RhCl_6].9H_2O$, etc., can be used in this invention.

The above-described rhodium salt may be added to the silver halide emulsion in any period before finishing the 1st ripening at the production of the emulsion but it is particularly preferably added during the formation of the silver halide grains. The addition amount of the rhodium salt is generally $1\times10^{-7}$ mol to $1\times10^{-4}$, preferably $1\times10^{-6}$ mol to $5\times10^{-5}$ mol per mol of silver.

The photographic material of the present invention can contain a wide variety of compounds for purposes of preventing fogging and stabilizing photographic characteristics during production, storage or photographic processing. More specifically, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds such as oxazolinethione; azaindenes such as triazaindenes, tetraazaindenes (especially (1,3,3a,7) tetrazaindenes substituted with a hydroxy group at the 4-position), pentaazaindenes, etc., and many other compounds known as an antifoggant or a stabilizer, such as benzenethiosulfonic acid, benzenesulfinic acids, benzenesulfonic acid amides and so on can be added to the photographic material of the present invention.

The photographic emulsion and light-insensitive hydrophilic colloids which constitute the photographic material of the present invention may contain inorganic or organic hardeners, if desired.

Examples of hardeners which can be used include chrome salts (e.g., chrome-alum, chromium acetate, etc.), aldehydes (e.g., formaldehyde, glyoxal, glutaraldehyde, etc.), N-methylol compounds (e.g., dimethylolurea, methylol dimethylhydantoin, etc.), dioxane derivatives (e.g., 2,3-dihydroxydioxane, etc.), active vinyl compounds (e.g., 1,3,5-triacryloyl-hexahydro-s-triazine, bis(vinylsulfonyl) methyl ether, N,N'-methylenebis {β-(vinylsulfonyl)propioneamide}, etc.), active halogen compounds (e.g., 2,4-dichloro-6-hydroxy-s-triazine, etc.), mucohalogen acids (e.g., mucochloric acid, mucophenoxychloric acid, etc.), isoxazoles, dialdehyde starch, and 2-chloro-6-hydroxytriazinyl-modified gelatin. These hardeners can be used alone or as a combination thereof, and specific examples thereof are described in U.S. Pat. Nos. 1,870,354, 2,080.019, 2,726,162, 2,870,013, 2,983,611, 2,992,109, 3,047,394 3,057,723 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427, Japanese Patent Publication Nos. 7133/59 and 1872/71, etc.

The light-sensitive emulsion layers and/or light-insensitive hydrophilic colloid layers of the present invention may contain surface active agents for various purposes, such as coating aids, prevention of static charging improvement of slippability, emulsifying dispersions, prevention of adhesion, and improving photographic characteristics.

Gelatin is employed to advantage as a binder or a protective colloid of photographic emulsions per this invention. Hydrophilic colloids other than gelatin can also be used. For instance, other colloids which can be used include proteins such as gelatin derivatives, graft copolymers of gelatin and other high molecular weight polymers, albumin, casein, etc.; sugar derivatives such as cellulose derivatives (e.g., hydroxyethyl cellulose, carboxymethyl cellulose, cellulose sulfate, etc.), sodium alginate, starch derivatives and the like; and various kinds of synthetic hydrophilic macromolecular substances such as homo- or co-polymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Not only can lime-processed gelatin be used but also acid-processed gelatin may be used. Further, hydrolysis products of gelatin and enzymatic degradation products of gelatin can also be employed.

The photographic emulsions of the present invention can contain dispersions of water insoluble or slightly water soluble synthetic polymers for the purpose of improving dimensional stability and so on. Examples of such polymers include those containing as constituent monomers an alkyl(metha)acrylate, an alkoxyalkyl(metha)acrylate, a glycidyl(metha)acrylate, a (metha)acrylamide, a vinyl ester (e.g., vinyl acetate), acrylonitrile, an olefin, a styrene and so on, individually or as a combination of two or more thereof, or as a combination of one or more of the above-described monomers with acrylic acid, methacrylic acid, an α,β-unsaturated dicarboxylic acid, a hydroxyalkyl(metha)acrylate, a sulfoalkyl(metha)acrylate, styrenesulfonic acid, and so on. Specific examples of polymers which can be used for the above-described purpose are described, for example, in U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373.

For obtaining photographic images of very high contrast (10 or more in γ value) using the silver halide photographic material of this invention containing a hydrazine derivative and/or a tetrazolium compound, a stable developer can be used without need for use of a conventional "unstable" infectious developer (lithographic developer). In other words, for the above-described silver halide photographic material, a developer containing a sufficient amount (in particularly, at least 0.15 mol/liter, preferably, 0.15 to 1.2 mol/liter) of sulfite ion as a preservative. The pH of the developer is at least 9.5, particularly 10.5 to 12.3 in the case of using a hydrazine derivative, or is in the range of 9 to 12, particularly in the range of 10 to 11, in the case of using a tetrazolium compound.

The developing agent used in a developer employed for processing the photographic light-sensitive material of the present invention does not have any particular restrictions. However, it is desirable for the developing agent to include a dihydroxybenzene(s) since excellent half-tone quality is easy to obtain. In some cases, combinations of dihydroxybenzenes and 1-phenyl-3-pyrazolidones, or combinations of dihydroxybenzenes and p-aminophenols, can be employed as developing agent.

Developing agents of the dihydroxybenzene type used in the above processing include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and the like. Of these hydroquinones, hydroquinone is especially useful.

Developing agents of the 1-phenyl-3-pyrazolidone type which can be used in the above processing include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and the like.

Developing agents of the p-aminophenol type which can be used in the above processing include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, and the like. Of these compounds, N-methyl-p-aminophenol is especially useful.

In general, the developing agent(s) is/are used in an amount ranging from 0.05 mol/l to 0.8 mol/l. When combinations of dihydroxybenzenes with 1-phenyl-3-pyrazolidones or p-aminophenols are employed, it is most effective to use the former in an amount of 0.05 mol/l to 0.5 mol/l and the latter in an amount of 0.06 mol/l or less.

Preservatives of the sulfite type used in the processing of the photographic light-sensitive material of the present invention include sodium sulfite, potassium sulfite, lithium sulfite, ammonium sulfite, sodium bisulfite, potassium metabisulfite, an addition product of an aldehyde and sodium bisulfite, etc. A preferred addition amount of sulfite is 0.4 mol/l or more, particularly 0.5 mol/l or more, and the upper limit thereof is up to 2.5 mol/l.

Alkali agents used for pH adjustment include pH controlling agents and buffering agents, such as sodium hydroxide, potassium hydroxide, sodium carbonate, potassium carbonate, sodium tertiary phosphate, potassium tertiary phosphate, etc.

In addition to the above-described ingredients, additives such as a development inhibitor (e.g., boric acid, borax, sodium bromide, potassium bromide, potassium iodide, etc.), an organic solvent (e.g., ethylene glycol, diethylene glycol, triethylene glycol, dimethyl formamide, methyl cellosolve, hexylene glycol, ethanol, methanol, etc.), and an anti-foggant or an agent for preventing black spots such as black pepper (e.g., mercapto compounds such as 1-phenyl-5-mercaptotetrazole, sodium 2-mercaptobenzimidazole-5-sulfonate, etc., indazole compounds such as 5-nitroindazole, etc., benzotriazole compounds such as 5-methylbenzotriazole, etc., and so on) may be contained in the developer. Further, the developer may optionally contain a toning agent, a surface active agent, a defoaming agent, a water softener, a hardener, an amino compound as described in Japanese patent application (OPI) No. 106244/81, etc.

The following example is intended to illustrate this invention in detail but not to limit it in any way.

EXAMPLE 1

Two kinds of Emulsions A and B were prepared using the following Solutions I and II by the methods shown below.

Solution I: 300 ml of water and 9 g of gelatin

Solution II: 100 g of silver nitrate and 400 ml of water (1) Emulsion A (Rhodium: $0.5\times10^{-5}$ mol/mol-silver Solution IIIA: 37 g of sodium chloride, 1 mg $(NH_4)_3RhCl_6$ and 400 ml of water.

To Solution I maintained at 45° were simultaneously added solution II and solution IIIA at a constant speed to form a silver halide emulsion. After removing soluble salts from the emulsion by a Conventional method, gelatin and a stabilizer, 6-methyl-4-hydroxy-1,3,3a,7-tetraazaindene, were added to the emulsion. The mean grain size of the silver halide grains in the silver halide emulsion thus formed was 0.20 μm and the amount of gelatin was 60 g per kg of the amount of the silver halide emulsion.

(2) Emulsion B (Rhodium $5\times10^{-5}$ mol/mol-silver

Solution IIIB: 37 g of sodium chloride, 10 mg of $(NH_4)_3RhCl_6$, and 400 ml of water.

Emulsion B was prepared in the same manner as Emulsion A using Solution IIIB in place of Solution IIIA.

To each of the Emulsions thus prepared were added a hydrazine derivative, the yellow dye of this invention and an ultraviolet absorbent in the amounts shown in Table 1 below and, after further adding thereto a dispersion of polyethyl acrylate and 2-hydroxy-4,6-dichloro-1,3,5-triazine sodium salt, each mixture was coated on a polyethylene terephthalate film at a silver coverage of 3.5 g/m$^2$.

An aqueous gelatin solution was then coated on the silver halide emulsion layer as a protective layer at a gelatin coverage of 1 g/m$^2$.

Each of the light-sensitive samples thus obtained was exposed to light through an optical wedge using a P-607 Type Printer, made by Dainippon Screen Mfg. Co., Ltd. developed for 20 sec. at 38° C. with a developer having the composition shown below, and then stopped, fixed, washed and dried. The quality of white lettering on the black background and the suitability for use under a safe light were compared for these samples subjected to the above-described development processing. The results obtained are shown in Table 1.

| Developer: | |
|---|---|
| Ethylenediamine tetraacetic Acid Di-Sodium Salt | 1.0 g |
| Sodium Hydroxide | 9.0 g |
| Potassium Tertiary Phosphate | 74.0 g |
| Potassium Sulfite | 90.0 g |
| 3-Diethylamino-1-propanol | 15.0 g |
| N—Methyl-p-aminophenol ½ Sulfate | 0.8 g |
| Hydroquinone | 35.0 g |
| 5-Methylbenzotriazole | 0.5 g |
| Sodium bromide | 3.0 g |
| Water to make | 1 liter |

(pH 11.6)

TABLE 1

| Sample No. | Emulsion (Rhodium: mol/mol-Ag | Amount III - 26* (mol/mol-Ag) | Amount of I - 1* (g/m²) | Amount of II - 2* (g/m²) | (A)(1) | γ(2) | (B)(3) | (C)(4) | (D)(5) 30 min. | (D)(5) 30 min. | (E)(6) |
|---|---|---|---|---|---|---|---|---|---|---|---|
| 1 | A(0.5 × $10^{-5}$) | 4 × $10^{-4}$ | — | — | 1600 | 20 | 4 | 3 | 5.00 | 5.00 | 5.00 |
| 2 | A(0.5 × $10^{-5}$) | " | 0.2 | — | 1000 | 18 | 4 | 3 | 0.01 | 5.00 | 0.01 |
| 3 | A(0.5 × $10^{-5}$) | " | — | 0.1 | 200 | 16 | 5 | 5 | 5.00 | 5.00 | 5.00 |
| 4 | A(0.5 × $10^{-5}$) | " | 0.2 | 0.1 | 125 | 15 | 5 | 5 | 0.01 | 5.00 | 0.01 |
| 5 | B(5 × $10^{-5}$) | " | — | — | 100 | 13 | 3 | 3 | 0.01 | 0.01 | 0.01 |

(A): Relative sensitivity;
(B): White lettering quality on black background;
(C): Tape adherence traces and pin hole marks;
(D): Fog (1) after safe light irradiation;
(E): Fog (2) after safe light irradiation.
*Compounds are as earlier identified In Table 1;

(1): Relative sensitivity is shown by the reciprocal of the exposure amount providing a density of 1.5 with that of Sample 5 being defined as 100.

(2): $\gamma=(3.0-0.3)/-[\log(a)-\log(b)]$.

(a): Exposure amount giving a density of 0.3

(b): Exposure amount giving a density of 3.0.

(3): White lettering on black background evaluated as follows. That is, as shown in Japanese patent application (OPI) No. 190,943/83, a film assembly formed by disposing a base film, a film having a line positive image (line image original), a base film and a film having a dot image (dot image original) in this order is intimately contacted with each of the samples prepared above with the protective layer of the sample and the dot image original in face-to-face relationship, an appropriate exposure is applied thereto in such a manner that 50% dot area becomes 50% dot area on the film sample and then the film is processed as described above. In this case, a sample capable of reproducing a letter of 30 μm in width as the line image original is evaluated as Rank 5, a sample which can reproduce only a letter of 150 μm or more in width is evaluated as Rank 1, and Rankings 4, 3, and 2 are formed between Rank 5 and Rank 1. Rank 2 represents a usable limit.

(4) Tape adhering traces and pin hole marks were evaluated as follows.

The original for evaluating the quality of white lettering on a black background was prepared by fixing a line image original or a dot image original on a film base using an adhesive tape. The possibility of dust and dirt attaching to the surfaces of the original or the photographic light-sensitive material also exists, of course. Accordingly, when light exposure and processing are performed as in the case of evaluating the quality of white lettering on a black background uing the aforesaid original and/or photographic light-sensitive material, transparent portions such as tape adhering traces and pin hole marks caused by dust and dirt form on portions which are light-exposed and essentially must be blackened.

Two white portions such as the tape adhering traces and pin hole marks are evaluated with a visual sense into 5 ranks (Rank 1 is the worst and Rank 5 is the best). Rank 3 is the usable limit.

(5): Fog (1) after safe light irradiation.

Fog formed when each sample is developed after irradiation with a fading preventing fluorescent lamp (FLR 40 SW-DL-X NU/M) made by Toshiba Corporation for 30 minutes or 60 minutes under about 200 lux.

(6): Fog (2) after safe light irradiation.

Fog formed when each sample is developed after irradiation with a fading preventing fluorescent lamp (FLR 40) SW-DL-X NU/M) made by Toshiba Corporation using a sharp cut filter SC-402 (a filter with 50% transmittance at 420 n.m., absorbing light of shorter wavelengths than 420 n.m. and transmitting light of longer wavelengths for 60 minutes under about 200 lux.

From the results shown in Table 1, it can be seen that Sample 4 of thi invention gave good quality white lettering on a black background and resulted in less tape adhering traces and pin hole marks and was excellent as compared with comparison Samples 1, 2, 3, and 5. On comparing Sample 1 with Samples 2 and 3, it can be seen that yellow Dye (I-1) is effective to improve the ability to be handled under a safe light and Ultraviolet Absorbent (II-20) is effective to improve the quality of the white lettering on a background and to prevent the formation of tape adhering traces and pin hole marks.

Also, it can be seen that when a sharp cut filter SC-42 is applied to the fading preventing fluorescent lamp, the safe light safety of Sample 4 per this invention was further improved.

While the invention has been described in detail and with reference to specific embodiments thereof, it will be apparent to one skilled in the art that various changes and modification can be made therein without departing from the spirit and scope thereof.

What is claimed is:

1. A silver halide photographic material for a bright room comprising a support having thereon at least one silver halide emulsion layer containing silver chloride grains or silver chlorobromide grains containing at least 80 mol% silver chloride, at least one of said silver halide emulsion layer or another hydrophilic colloid layer(s) present containing a yellow dye making the silver halide photographic material substantially insensitive to visible light of 420 n.m. or more and an ultraviolet absorbent in an amount sufficient to reduce the specific sensitivity of the silver halide emulsion at 360 n.m. to ½ or lower than ½ thereof in the absence of the ultraviolet absorbent, and the γ value of the silver halide photographic material being at least 10.

2. The silver halide photographic material for a bright room as claimed in claim 1, wherein the silver chloride grains or silver chlorobromide grain in the silver halide emulsion layer contain a rhodium salt in an amount of $1\times10^{-7}$ to $1\times10^{-4}$ per mol of silver.

3. The silver halide photographic material for a bright room as claimed in claim 1, wherein the yellow dye is selected from the group consisting of oxonol dyes, hemioxonol dyes, merocyanine dyes, cyanine dyes and azo dyes.

4. The silver halide photographic material for a bright room as claimed in claim 1, wherein the ultraviolet absorbent is selected from the group consisting of aryl group-substituted benzotriazole compounds, 4-thiazolidone compounds, benzophenone compounds, cinnamic acid ester compounds, benzophenone compounds, cinnamic acid ester compounds, butadiene compounds, benzoxazole compound and ultraviolet absorptive polymers.

5. The silver halide photographic material for a bright room as claimed in claim 1, wherein the yellow dye is used in an amount of $10^{-3}$ g/m$^2$ to 1 g/m$^2$.

6. The silver halide photographic material for a bright room as claimed in claim 1, wherein the ultraviolet absorbent is used in an amount of $10^{-3}$ g/m$^2$ to 1 g/m$^2$.

7. The silver halide photographic material for a bright room as claimed in claim 1, wherein the silver halide emulsion layer, another hydrophilic colloid layer or both of them contain hydrazine derivatives.

8. The silver halide photographic material for a bright room as claimed in claim 7, wherein the hydrazine derivatives are selected from compounds represented by formula (III-1) or (III-2)

$$R_1-NHNH-G-R_2 \qquad \text{(III-1)}$$

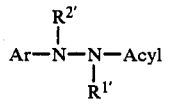

(III-2)

wherein $R_1$ represents an aliphatic or aromatic group or unsaturated heterocyclic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group; Acyl is an acyl group; Ar is an aryl group, and $R^{1'}$ is a hydrogen atom or a sulfinic acid radical substituent and $R^{2'}$ is a sulfinic acid radical substituent when $R^{1'}$ is hydrogen atom and hydrogen atom when $R^{1'}$ is a sulfinic acid radical.

9. The silver halide photographic material for a bright room as claimed in claim 1, wherein the silver halide emulsion layer, another hydrophilic colloid layer or both of them contain tetrazolium compounds.

10. The silver halide photographic material for a bright room as claimed in claim 9, wherein the tetrazolium compound is selected from the compounds represented by formulae (IV), (V) and (VI)

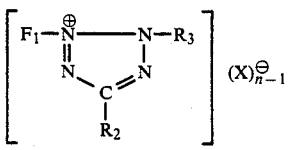

(UV)

-continued

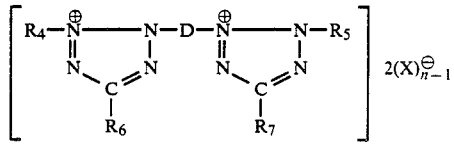

(V)

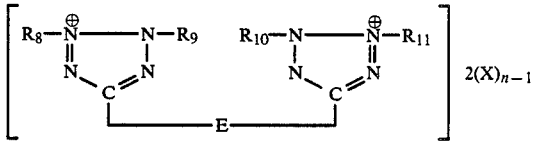

(VI)

wherein $R_1$, $R_3$, $R_4$, $R_5$, $R_8$, $R_9$, $R_{10}$ and $R_{11}$ each represents an allyl group, a pheny group, a naphthyl group or a heterocyclic group or a group forming a metal chelate or a complex; $R_2$, $R_6$ and $R_7$ each represents an allyl group, a phenyl group, a naphthyl group, a heterocyclic group, an alkyl group, a hydroxy group, a carboxy group or a salt thereof, a carboxyalkyl group, a mercapto group, a nitro group or a hydrogen atom; D represents a divalent aromatic group; E represents an alkylene group, an arylene group, or an aralkylene group; and n represents 1 or 2, n being 1 when the compound of each formula forms an intermolecular salt.

11. A process for producing an image in a silver halide photographic material for a bright room, the $\gamma$ value of the silver halide photographic material being at least 10, comprising developing a silver halide photographic material comprising a support having thereon at least one silver halide emulsion layer containing silver chloride grains or silver chlorobromide grains containing at least 80 mol% silver chloride, at least one of said silver halide emulsion layer(s) or another hydrophilic colloid layer(s) present containing a yellow dye making the silver halide photographic material substantially insensitive to visible light of 420 n.m. or more, an ultraviolet absorbent in an amount sufficient to reduce the specific sensitivity of the silver halide emulsion at 360 n.m. to $\frac{1}{2}$ or lower than $\frac{1}{2}$ thereof in the absence of the ultraviolet absorbent, with a developer of pH 10.5–12.3, at least one of said silver halide emulsion layer(s), said another hydrophilic colloid layer(s), or both said at least one silver halide emulsion layer(s) and said another hydrophilic colloid layer(s) containing one or more hydrazine compounds.

12. A process for producing an image in a silver halide photographic material for a bright room, the $\gamma$ value of the silver halide photographic material being at least 10, comprising developing a silver halide photographic material comprising a support having thereon at least one silver halide emulsion layer containing silver chloride grains or silver chlorobromide grains containing at least 80 mol% silver chloride, at least one of said silver halide emulsion layer(s) or another hydrophilic colloid layer(s) present containing a yellow dye making the silver halide photographic material substantially insensitive to visible light of 420 n.m. or more, an ultraviolet absorbent in an amount sufficient to reduce the specific sensitivity of the silver halide emulsion at 360 n.m. to $\frac{1}{2}$ or lower than $\frac{1}{2}$ thereof in the absence of the ultraviolet absorbent, with a developer of pH 9 to 12, at least one of said silver halide emulsion layer(s), said another hydrophilic colloid layer(s), or both said at least one silver halide emulsion layer(s) and said another hydrophilic colloid layer(s) containing one or more tetrazolium compounds.

* * * * *